US005595082A

United States Patent [19]

Gandara

[11] Patent Number: 5,595,082

[45] Date of Patent: Jan. 21, 1997

[54] SHEET METAL CORRUGATOR

[75] Inventor: Enrique P. Gandara, Garland, Tex.

[73] Assignee: Gandara Systems, Garland, Tex.

[21] Appl. No.: 510,587

[22] Filed: Aug. 2, 1995

Related U.S. Application Data

[63] Continuation-in-part of Ser. No. 374,832, Jan. 19, 1995, Pat. No. 5,494,261.

[51] Int. Cl.[6] ..... B21D 13/04

[52] U.S. Cl. ..... 72/196; 72/379.6

[58] Field of Search ..... 72/190, 196, 379.6; 425/369, 370

[56] References Cited

U.S. PATENT DOCUMENTS

| | | | |
|---|---|---|---|
| 827,419 | 7/1906 | Causer | 72/190 |
| 1,449,596 | 3/1923 | Fraidus | 72/196 |
| 2,643,688 | 6/1953 | Crooker | 72/190 |
| 2,663,351 | 12/1953 | Osborne et al. | 425/370 |
| 2,715,017 | 8/1955 | Weimer | 256/65 |
| 2,971,558 | 2/1961 | Vicknair, Jr. | 72/196 |
| 3,034,610 | 5/1962 | Lynch | 189/36 |
| 3,037,593 | 6/1962 | Webster | 189/34 |
| 3,101,929 | 8/1963 | Dvore | 256/24 |
| 3,305,221 | 2/1967 | Kling | 256/21 |
| 4,179,912 | 12/1979 | Culina et al. | 72/196 |
| 4,608,848 | 9/1986 | Mele | 72/184 |
| 4,736,566 | 4/1988 | Krotsch | 52/795 |

FOREIGN PATENT DOCUMENTS

| | | | |
|---|---|---|---|
| 1071246 | 4/1954 | France | 52/798.1 |
| 15287 | 7/1964 | Japan | 72/196 |
| 863271 | 3/1921 | United Kingdom | 52/781 |

OTHER PUBLICATIONS

"Attractive and Durable, Color–Coated, Galvanized Steel" by Rohn Privacy Paneling, 1992.

"Unparalleled Style and Value For Commercial, Industrial and Residential Use" advertising brochure, Monumental Iron Works™, 1994.

*Primary Examiner*—Lowell A. Larson

*Attorney, Agent, or Firm*—Sidley & Austin

[57] ABSTRACT

A corrugating machine has a top reel and a bottom reel, each with roller bars that intermesh with each other so that sheet metal that is passed therebetween can be corrugated in a uniform manner. The roller bars deform the sheet stock into the corrugations, but prevent marring of the precoated finish on the sheet metal.

20 Claims, 8 Drawing Sheets

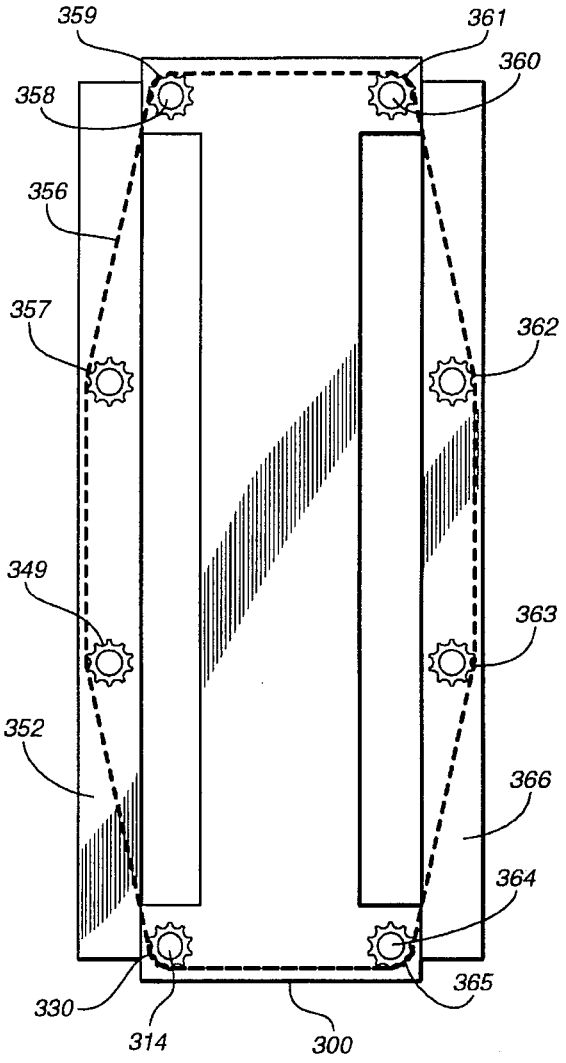
FIG. 11
FIG. 10
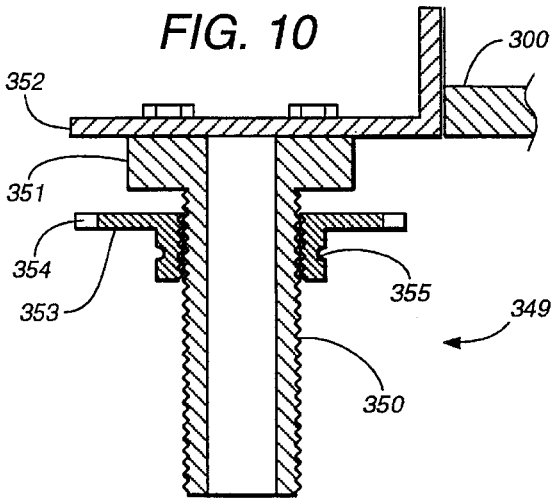

SHEET METAL CORRUGATOR

RELATED APPLICATION

This patent application is a continuation-in-part of U.S. Ser. No. 08/374,832, filed Jan. 19, 1995, now U.S. Pat. No. 5,494,261, issued Feb. 27, 1996, and entitled "Corrugated Privacy Fence and Method of Fabrication Thereof."

TECHNICAL FIELD OF THE INVENTION

The present invention relates in general to methods and apparatus for fabricating and forming corrugated sheet metal, and more particularly for fabricating corrugated panels for private fences.

BACKGROUND OF THE INVENTION

Fences have been utilized for many centuries for a host of different purposes. As a result, many different types of fences and fence structures have been employed and styled to meet specific purposes. In view of the increase in population, as well as the density of the populace, especially in suburban and metropolitan areas, fences have emerged as a necessity for safety as well as privacy.

While many fences and dividers are constructed with brick, stone and other nondestructable materials, such type of fences are very costly and are not easily or quickly constructed. On the other hand, wooden fences comprised of a number of vertical boards placed edge to edge, have experienced a great deal of popularity, due basically to the low cost, availability and the expediency by which such type of fences can be constructed. The wooden type fences range from 6–8 feet in height, and provide a substantial degree of privacy, as well as security in preventing unauthorized entry to the enclosed premises.

Wooden fences are generally constructed by anchoring either metal posts or wooden posts in the ground, via a concrete base. Then, three or more lateral wooden supports are fastened between the posts. Lastly, the vertical wooden boards or slats are quickly nailed or stapled to the lateral supports, thus completing the fence. Hinged gates and the like can be made in a similar fashion, and fastened to the vertical posts by hinges and latch mechanisms. Many different types and variations of this type of fence are available. While the vertical posts are often made of a treated wood which is highly resistant to deterioration due to moisture and insects, the lateral supports and the vertical fence boards are often made of pine or cedar, and thus last only between 5–10 years. It can be appreciated that a substantial disadvantage with wooden fences is thus the short life thereof, until some or all of the boards require replacing.

As a result of the popularity of the wood-type fences, the fabrication and the instillation of the same requires a high degree of efficiency to remain competitive. By and large, to remain competitive in installing fences, automatic nail and staple guns are utilized to expedite instillation. While eight-foot sections of wood fences can be purchased pre-assembled, the instillation time thereof is reduced, at the expense of increased cost.

In accordance with the foregoing, a need exists for a machine that can easily and efficiently form corrugations in a precoated galvanized sheet, without scratching or otherwise marring the finish.

SUMMARY OF THE INVENTION

In accordance with the principles and concepts of the present invention, a sheet metal corrugating machine, and method of fabrication thereof, substantially reduces or eliminates the disadvantages and shortcomings associated with prior art machines.

In accordance with a primary feature of the invention, a corrugator machine is provided for corrugating precoated sheets of metal stock. The corrugator machine according to the invention includes a top rotatable reel and a bottom rotatable reel, each with a number of roller bars that loosely interlock with each other when the reels are rotated. As the precoated metal sheet stock is passed between the reels, the roller bars deform the metal into corrugations. However, as the sheet metal passes between the roller bars and is deformed into the corrugations, the roller bars also rotate so that no sliding or relative movement exists between the roller bars and the corrugated sheet metal. With this technique, sheet metal that is precoated on both sides thereof is not stretched, marred or otherwise scratched as it is formed into the corrugated panels as it passes between the upper and lower reels.

According to yet another feature of the invention, the upper reel can be adjusted vertically with respect to the bottom reel to form corrugations to different depths. Also, the top and bottom reels can both be pivoted about a vertical axis with respect to an in-feed table so that corrugations can be formed at an angle in the sheet metal stock.

BRIEF DESCRIPTION OF THE DRAWINGS

Further features and advantages will become apparent from the following and more particular description of the preferred and other embodiments of the invention, as illustrated in the accompanying drawings which like reference characters generally refer to the same parts, elements or functions throughout the views, and in which:

FIG. 10 is a cross-sectional view of a sprocket idler for maintaining alignment and tension on the adjustment chain;

FIG. 11 is a top sectional view showing the chain-driven mechanism for vertically adjusting the distance between the top reel and the bottom reel.

DETAILED DESCRIPTION OF THE INVENTION

Figure 1:
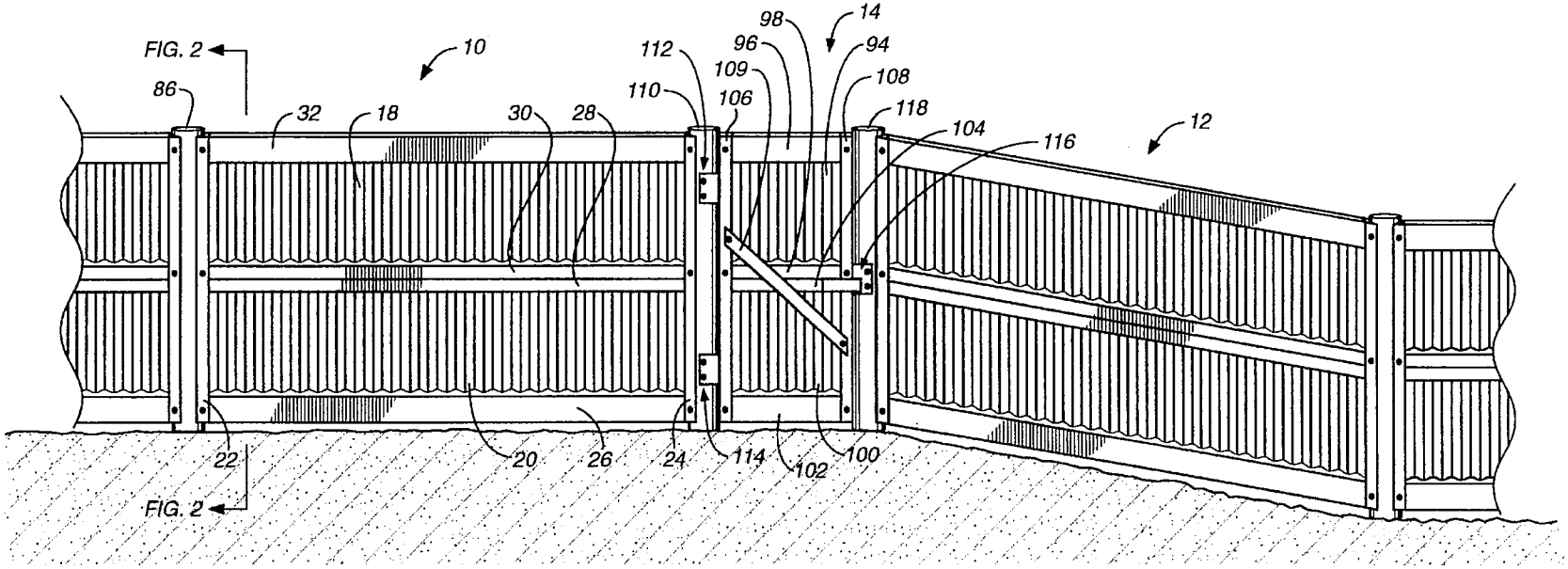
FIG. 1 is a frontal elevation view of a corrugated metal fence structure according to the invention, where a horizontal fence section is shown joined to an angled fence section by a hinged gate.

FIG. 1 illustrates a number of different components of the fence structure. Shown is a section 10 of fence adapted for installation on generally level ground, in conjunction with a section 12 of fence adapted for installation over inclined ground surfaces, with both sections 10 and 12 coupled together by a hinged gate 14. The components of the fence structures shown in FIG. 1 are constructed entirely of a precoated galvanized sheet metal to provide a corrosion resistant fence with an extremely long life. Currently available are coils of precoated sheet metal of various colors, embossing, laminating and striping designs. An important feature not available with wood fences, is that the present fence structure does not have a back side or front side for appearance purposes, but rather the; front and back sides of the fence are symmetrical and thus are identical in appearance.

The fence sections 10 that are installed over generally level ground are rectangular in shape and include two corrugated panels 18 and 20, where the corrugations are formed transverse to the long, horizontal edges. The upper panel 18 and the lower panel 20 are held within a channel frame structure without the use of fasteners. The frame structure includes, in the order of installation, a left vertical channel 22, a right vertical channel 24 and a bottom full channel stiffener 26 that is secured by self-tapping screws to the bottom of the vertical channels 22 and 24. After the bottom panel 20 is installed between the vertical channels 22 and 24 and secured in the channel portion of the bottom full stiffener 26, a center half stiffener 28 is lowered in the vertical channels 22 and 24 to secure and stiffen the top corrugated edge of the bottom panel 20. Another center half stiffener is inverted (with the channel facing upwardly) and installed between the vertical channels 22 and 24 and fastened thereto with self-tapping screws. Then, the upper corrugated panel 18 is installed between the vertical channels 22 and 24 and captured at its bottom corrugated edge in the channel opening of the center half stiffener 30. Lastly, the top full stiffener 32 is installed between the vertical channels 22 and 24 to capture and constrain the top edge of the upper corrugated panel 18.

The fence section 12 is utilized for installations above ground surfaces that are inclined. The fence sections 12 are trapezoidal in shape, as shown in FIG. 1, where the opposing vertical channels remain vertically oriented, but the remainder of the fence components, e.g., the full and half stiffeners as well as the corrugated upper and lower panels, are generally inclined and parallel to the ground surface. In this manner, the fence structures of the invention can accommodate irregular ground contours to thereby follow the slope of the ground surface and provide a high degree of security as well as an aesthetically pleasing fence structure.

Figure 2:
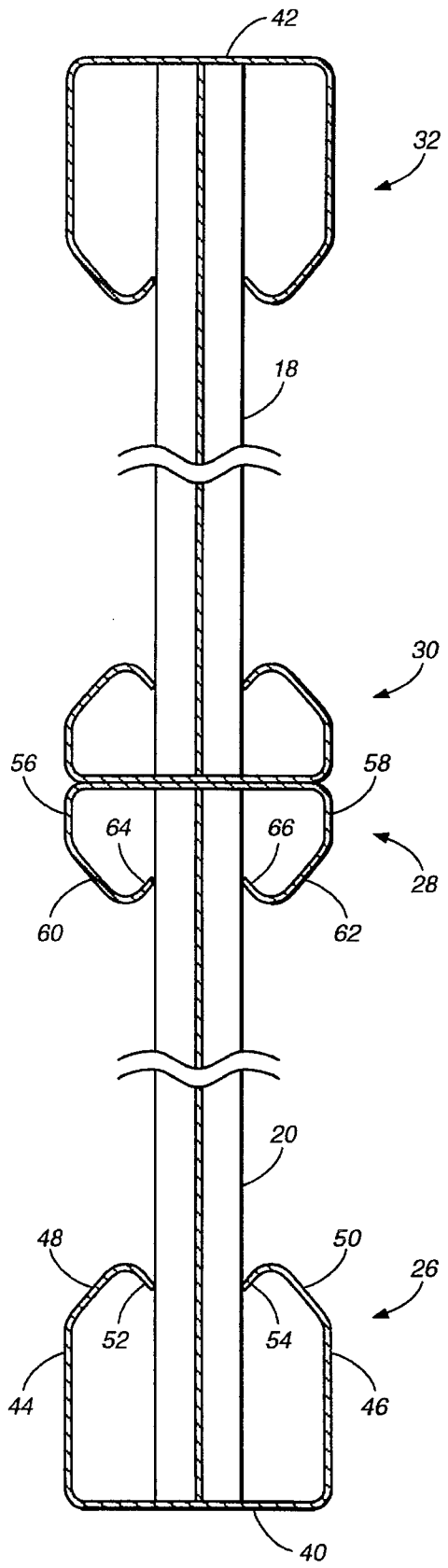
FIG. 2 is a vertical cross-sectional view of the fence, taken along line 2—2 of FIG. 1.

FIG. 2 illustrates in more detail the structural features of the fence section 10. The upper panel 18 and the lower panel 20 are constructed of a thirty gauge sheet metal, preferably of 36 or 48 inch height and 91 inch width. The panels 18 and 20 have formed therein surface irregularities, preferable vertical corrugations to provide rigidity and strength thereto. In the preferred embodiment of the invention, the corrugations are formed with curved surfaces having a valley to a peak dimension of about one inch, with about 3.5 inches between successive peaks. Of course, those skilled in the art may prefer to construct the panels 18 and 20 of different size and shapes of corrugations. Indeed, irregular shaped surfaces or corrugated panels having angled sides and flat outer surfaces may be utilized to achieve acceptable rigidity. Apparatus for forming rounded corrugations will be described in more detail below. Further, in accordance with an important feature of the invention, the upper panel 18 and the lower panel 20 are constructed identically, and thus are interchangeable. The panels 18 and 20 are preferable painted or coated with a light color.

The bottom full stiffener 26 and the top full stiffener 32 of FIG. 2 are also constructed identically, and thus are fully interchangeable. The full stiffeners 26 and 32 are preferably constructed of a 22 gauge precoated galvanized sheet, having the general shape shown in FIG. 2. The stiffeners 26 and 32 each have a respective flat surface 40 and 42 that define the top or bottom of the fence section 10, depending upon whether the full stiffener is installed at the top or bottom of the fence. The flat surfaces 40 and 42 are preferably, although not necessarily, about 2.75 inches wide. Opposing parallel sides 44 and 46 are about 2.0 inches high, and are curved inwardly with sections 48 and 50 and terminate in opposing inwardly curved edges 52 and 54. The elongate edges 52 and 54 are spaced about one inch apart to accommodate the width of the corrugated panels 18 and 20. The inside radii of each of the six internal corners of the full stiffeners 26 and 32 are formed, preferably with a 0.25 inch radius. The cross-sectional shape of each half stiffener and full stiffener is uniform throughout the length thereof.

In accordance with an important feature of the invention, the corrugated panels, such as 20, fit snugly between the edges 52 and 54 of the full stiffeners. Indeed, as the corrugated panel 20 is forcefully pushed into the channel opening of the stiffener 26, the angled members 48 and 50 are forced apart somewhat, thereby providing a slight compression fit to the corrugated panel 20. In this manner, the panel 20 does not loosely engage with the full stiffener 26 and thereby allow the panel to rattle when vibrated, such as when subjected to wind turbulence. Rather, the half and full stiffeners firmly secure the corrugated panels therein. As noted in FIG. 2, the curved eddies 52 and 54 provide a tapered entrance into the channel, thus facilitating pushing the panel 20 therein by guiding the corrugated edge into the channel opening. In other words, the angled configuration of the full stiffeners, as well as the half stiffeners, provides a guiding function and a snug fit to the corrugated panels. As noted in FIG. 2, the corrugated panel 20 is inserted into the respective half and full stiffeners 28 and 26, until it bottoms out, thereby facilitating installation. The upper corrugated panel 18 similarly fits into the respective half and full stiffeners 30 and 32.

The half stiffeners 28 and 30 are constructed substantially identical to the full stiffeners 26 and 32, except the parallel side walls 56 and 58 are only about one inch high, and the sheet metal is 24 gauge. Also, the angled portions 60 and 62, together with the edges 64 and 66 compressively engage the corrugated panel 20 to provide a slightly tight fit. Again, the half stiffeners 28 and 30 are identical to each other, and thus are also interchangeable. The interchangability between the full stiffeners 26 and 32, as well as the interchangability between the half stiffeners 28 and 30 reduce the number of different components necessary to construct a fence. The reduced number of different components also facilitates the ease with which the components can be selected and the fence constructed.

The full stiffeners 26 and 32, as well as the half stiffeners 28 and 30, are made of precoated galvanized sheet metal, preferably of a darker color as compared to the panels, to provide a pleasing contrast with the light colored corrugated panels 18 and 20. Also facilitating the aesthetic appearance of the fence 10, is the aspect that when the half stiffeners 28 and 30 are placed with the respective top and bottom flat surfaces thereof engaged together, such as shown in FIG. 2, the collective height of the two half stiffeners is about the same height as each individual full stiffener 26 and 32. Thus, from a distance, and when the stiffeners are a different color than the panels, there is a degree of symmetry. In other words, when viewed from a distance, the height of each full stiffener 26 and 32 is the same as the collective height of both half stiffeners 28 and 30 placed one on top of the other. As noted in FIG. 2, it is not necessary to fasten the corrugated panels 18 and 20 to any of the half or full stiffeners.

Figure 3:
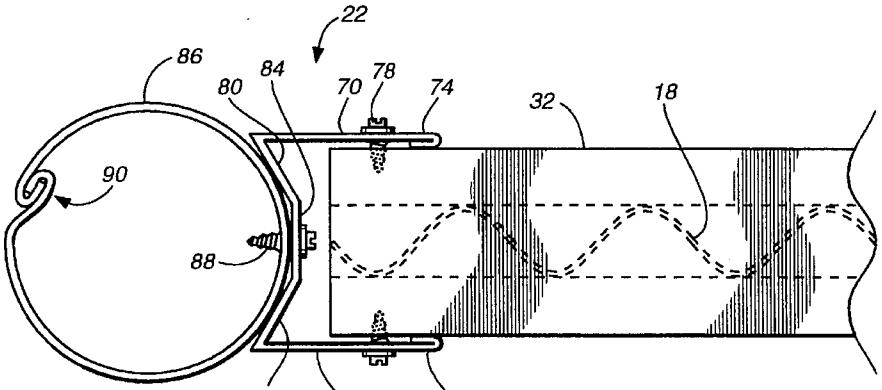
FIG. 3 is a top view of a portion of the fence structure, as it is connected via a vertical channel to a metal post.

With reference now to FIG. 3, there is depicted the manner in which the corrugated panels and stiffeners are fastened or otherwise attached to the vertical channels 22 and 24. It should be noted that while FIG. 3 illustrates the attachment of the fence components to the vertical channel 22, an identical arrangement is achieved with respect to the other vertical channel 24. The vertical channel 22 is preferably constructed of a 22 gauge precoated galvanized sheet metal in the same color as the half and full stiffeners. For fences constructed of typical 6-foot heights, the vertical channel 22 is preferably about 71 inches long. Of course, different lengths of vertical channels 22 can be constructed to achieve fences of different heights. The vertical channel 22 includes generally parallel sides 70 and 72, with a width of about 2.5 inches. Each elongated edge of the channel 22 is folded back on itself about one half inch, such as shown by reference characters 74 and 76. The folded back edges 74 and 76 eliminate sharp exposed side edges of the vertical channel 22. In accordance with another feature of the invention, the metal components of the fence have very few sharp edges, thereby reducing the possibility of inadvertent injury. The distance between the parallel sides 70 and 72 is preferably about 2-13/16 inches, while the distance between the folded back edges 74 and 76 is about 2.75 inch, the same as the width of the half and full stiffeners. The full stiffeners and the half stiffeners can be fabricated using contour roll forming machines. In like manner, the posts, the vertical channels, the gate vertical channels and stiffeners can also be formed by contour roll forming machines.

As noted in FIG. 3, the stiffeners each fit within the parallel sides 70 and 72 of the vertical channels. Each full stiffener 26 and 32 is fastened to each vertical channel 22 and 24 by a single self-tapping threaded fastener 78, on the front and back side of the fence. However, only the bottom half stiffener 30 associated with the upper panel 18 is fastened to the vertical channels 22 and 24 with a pair of fasteners 78, while the top half stiffener 28 of the bottom panel 20 does not need to be fastened to either of the vertical channels 22 and 24. This relatively few number of fasteners does not compromise the integrity or rigidity of the fence 10, but reduces the time required for assembly and installation thereof. The number of fasteners required on one side of the fence section 10 is shown in FIG. 1, it being realized that an equal number of self-tapping fasteners are utilized at the same respective locations on the other side of the fence 10.

It is noted in FIG. 3 that neither of the full stiffeners 26 or 32, or the half stiffeners 28 or 30, are fully abutted against the inside flat surface 84 of the vertical channels 22 and 24. This allows a fence section 10 of a specified width to be installed between fence posts that may vary by a few inches in the distance by which the posts are spaced apart. With this construction, the full and half stiffeners remain captured between the parallel side walls 70 and 72 of the vertical channels 22 and 24, even if the posts are spaced apart several inches more than they should be. This flexibility in the installation of the fence of the invention reduces criticality in the exact distance apart by which the posts are set into the ground. The vertical channel 22 includes angled surfaces 80 and 82 joined by a short section 84 that is generally perpendicular to the parallel sides 70 and 72. The angles between the angled portions 80 and 82 with respect to the parallel sides 70 and 72 is about 60°. As can be seen from FIG. 3, the surfaces 80, 82 and 84 accommodate a curved portion of the circular metal post 86. The surfaces 80, 82 and 84 of the vertical channels 22 and 24 could also be curved to accommodate the curvature of a metal post.

Importantly, the vertical channel 22 encompasses less than a fourth of the circumference of the metal post 86, thereby allowing for other similar vertical channels 22 to be fastened to the same post 86. A maximum of four vertical channels can be fastened to a metal post. Two self-tapping screws, such as noted by reference character 88, can be driven through the channel section 84 and into the metal post 86.

The metal post 86 is constructed of a 16 gauge precoated galvanized sheet, roll formed with an outside diameter of about 4 inches. Each vertical edge of the sheet metal of the post 86 is interlocked 90, as shown in FIG. 3. In accordance with an important feature of the invention, only a total of 16 self-tapping screws are utilized to fasten the components of the fence 10 together, as well as fasten the fence section to each metal post 86. This contrasts with the substantial number of nails or staples that are required to fasten each wooden board together to form a conventional wood fence.

As noted above, FIG. 1 illustrates a gate 14 adapted for use with the fence sections 10. The gate 14 includes an upper corrugated panel 94 held between a full stiffener 96 and a half stiffener 98. In like manner, the gate 14 includes a lower corrugated panel 100 held between a full stiffener 102 and a half stiffener 104. Both panels 94 and 100, as well as the respective stiffeners, are situated between vertical channels 106 and 108. In this manner, the gate 14 is constructed substantially identical to the fence section 10. Additionally, the gate includes a diagonal support member 109 that is secured by fasteners between the left vertical channel 106 and the right vertical channel 108. The diagonal support 109 comprises a section of U-shaped material with edge flanges that functions to prevent the gate 14 from sagging. The gate 14 is hingeably attached to the metal post 110 by a pair of hinge-support mechanisms, such as shown by reference characters 112 and 114. A latch mechanism 116 provides an attachment between the gate 14 and the post 118.

Figure 4:
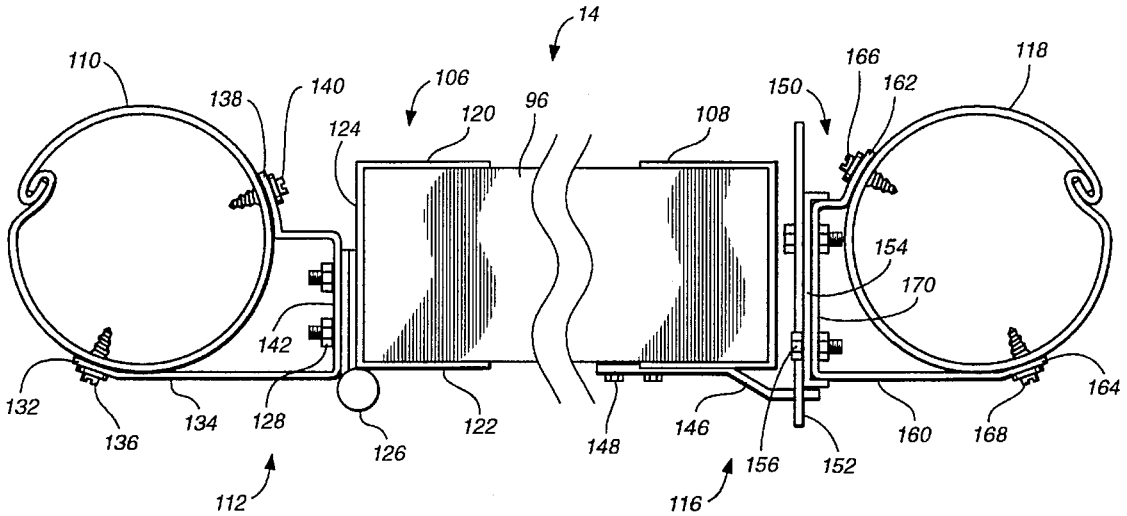
FIG. 4 illustrates a hinged connection of a gate, constructed according to the invention, to a post on one side thereof, and a latch structure on the other edge of the gate.

The hingable attachment and the security latch arrangement that supports the gate 14 between the posts 110 and 118 are shown in more detail in FIG. 4. Because the gate structure 14 does not fasten directly and rigidly to the metal post 110, the vertical upright channels 106 and 108 of the gate do not need the angled surfaces to accommodate the curvature of the post 110, as do the vertical uprights 22 and 24 of the fence section 10 as shown in FIG. 3. Rather, the vertical channels 106 and 108 can be formed of a 16 gauge precoated galvanized sheet with two opposing, parallel side members 120 and 122, and with a flat connecting member 124 formed perpendicular to the sides. In this manner, the vertical channel 106 is of simplified design requiring only two bends in the material. The other vertical upright 108 is identical, thus again providing an efficiency in manufacture as well as installation.

A conventional hinge 126 is fastened by screws (not shown) to the vertical channel 106, as well as fastened by bolts 128 to a hinge support member 112. The hinge support member 112 is formed of galvanized and painted sheet material that has a number of angle bends to firmly anchor the member 112 to the metal post 110, as well as provide a base to which the hinge 126 can be fastened. To that end, the hinge support member 112 has a short edge 132 bent somewhat inwardly with respect to a large face portion 134 to accommodate the curvature of the post 110. When a pair of self-tapping screws 136 are driven through the tab 132 and fastened into the post 110, the exposed vertical edge of the tab 132 is caused to remain flush against the outer surface of the post 110, thereby eliminating sharp edge portions of the hinge support member 112. The other edge of the hinge support member 112 includes a similar tab 138 that is also angled inwardly somewhat so that when a pair of self-tapping screws 140 are driven therethrough, the other exposed vertical edge of the hinge support member 112 remains flush against the outer surface of the post 110. The hinge support member 112 includes a flat base portion 142 that is spaced away from the post 110 a short distance to allow one plate of the hinge 126 to be fastened thereto by the bolts 128. The vertical height of the hinge support member 112 is about 4 inches, thereby providing a substantial area for fastening to the post 110 as well as for hingeably connecting the vertical channel 106 of the gate 14 thereto. In practice, it has been found that a pair of hinge support members 112 and a pair of corresponding hinges 126 are sufficient to fasten the gate 14 to a post 110, such as shown in FIG. 1.

A single latch mechanism 116 is utilized to securely latch the gate 14 to a metal post 118, such as shown in FIG. 4. The latch mechanism 116 includes a conventional latch that includes a tubular member 146 that is bolted or otherwise secured to one of the half stiffeners 98 or 104 by bolts, such as shown by reference character 148. As noted in FIG. 4, the end of the tubular member 146 protrudes beyond the edge of the vertical channel 108. A conventional gate catch mechanism 150 is utilized in cooperation with the tubular member 146 to latch the gate 14 securely and immovably to the post 118. The catch mechanism 150 includes a catch finger 152 with a hook (not shown) for engaging the end of the tubular member 146, thereby latching the parts together. The conventional catch mechanism 150 includes a base 154 to which the pivotal catch finger 152 can be secured by way of a padlock. Further, the catch base 154 is bolted with bolts 156 to the latch support member 160. The latch support member 160 has edge tabs 162 and 164 that are inwardly bent similar to the hinge support member 112 so that when self-tapping screws 166 and 168 are driven therethrough and into the metal post 118, the latch support member 160 is securely fixed thereto. The latch support member 160 includes a flat surface area 170 to which the catch base 154 is fastened, as noted above. Only a single latch support member 160 is required in conjunction with the catch mechanism 150, such as shown in FIG. 1, to latch the gate 14 to the metal post 118. The hinge support member 130 and the latch support member 160 are preferably constructed of a 16 gauge galvanized metal to provide a corrosion resistant and rigid structure for supporting the gate 14 between the posts 110 and 118. The hinge support member 112 and the latch support member 116 are preferably coated or painted the same color as the vertical channels 106 and 108, as well as the half and full stiffeners, e.g., a dark color. Of course, any color can be utilized to provide an aesthetic and coordinated color with respect to the corrugated panels of the fence and the gate.

The vertical channels 106 and 108 utilized as the gate supports can also be employed as a vertical support for a fence section 10, when the end of the section abuts against a flat surface, such as a wall. It can be appreciated that many fences terminate against the side of a house or building. The flat edge surface 124 of the fence channel 106 is well adapted for fastening to a flat surface with screws or the like.

Figure 5:
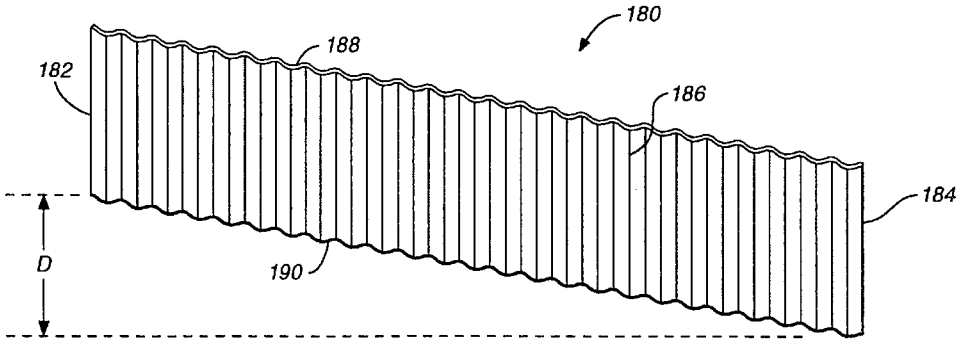
FIG. 5 is a frontal view of a corrugated panel of the type utilized with fence sections that are situated on inclined ground surfaces.

FIG. 5 illustrates a corrugated panel 180 adapted for use with fence sections 12 that are installed over inclined ground surfaces. The panel 180 is trapezoid in shape, with vertical side edges 182 and 184, as well as vertical corrugations 186. However, the top edge 188 and the bottom edge 190 are not perpendicular with respect to the side edges 182 and 184, but rather are angled to match the general angle of incline of the ground. Two such corrugated panels 180 are utilized in conjunction with half and full stiffeners, and vertical channels as described above, to construct the fence section 12. A number of different trapezoidal-shaped panels 180 can be constructed to match various angles of ground incline. With eight foot wide corrugated panels 180, standard trapezoidal shapes can be achieved by making the distance D in FIG. 5, for example, 5 inches, 10 inches, 15 inches and 20 inches, etc. The technique for fabricating the trapezoidal-shaped panels 180 will be described in detail below. Gate structures can be constructed in a manner similar to the inclined fence sections 12 to accommodate inclined ground surfaces.

Figure 6:
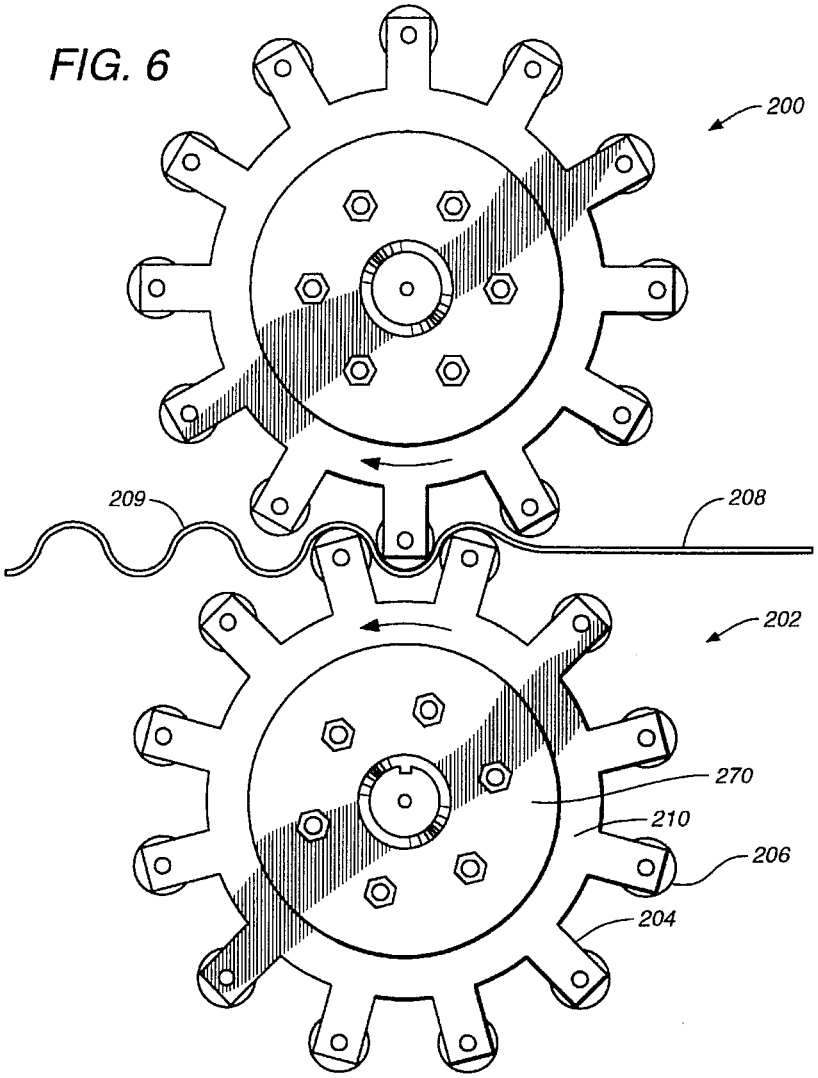
FIG. 6 illustrates the general construction of the intermeshing reels of the corrugator machine according to the invention.
Figure 7:
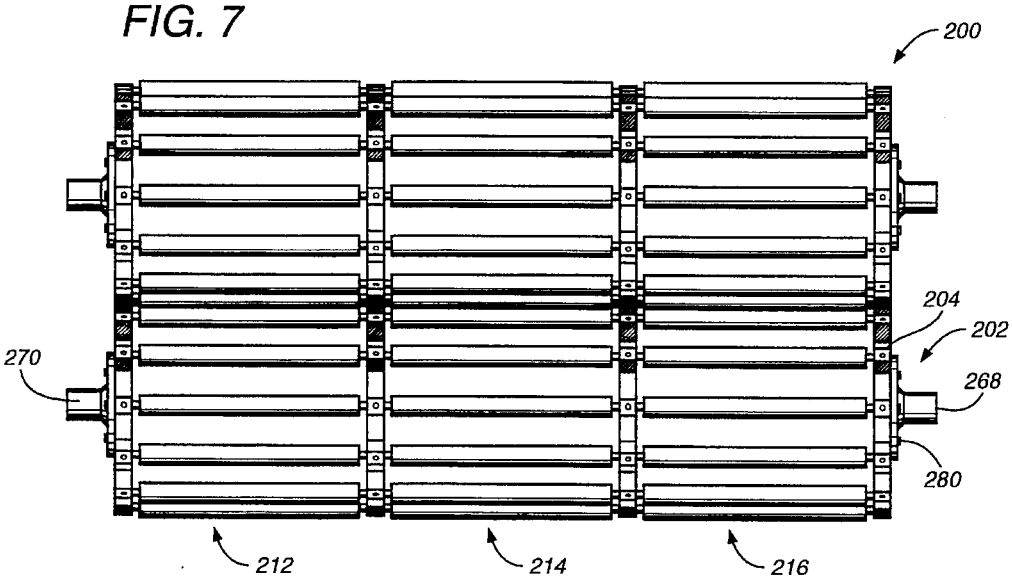
FIG. 7 is a frontal view of the three ganged sections of the intermeshing corrugating reels.

Referring now to FIGS. 6 and 7, the general principles and concepts of the corrugating machine of the invention are illustrated. A pair of rotatable spoked reels 200 and 202 rotate in an interlocking manner to form corrugations in precoated galvanized sheet metal that is passed between the reels. FIG. 7 shows generally a frontal view of the two intermeshing reels 200 and 202. According to the preferred embodiment of the invention each reel includes a number of spokes 204 that support roller bars 206. The roller bars of reel 200 loosely mesh with the roller bars of reel 202, much like a pair of toothed gears. When sheet metal stock, such as shown by numeral 208, is fed between the spoked reels 200 and 202, the roller bars 206 of both reels deform the sheet metal to form corrugations 209. Importantly, the sheet metal is not squeezed between alternate roller bars 206, but rather the sheet metal is simply bent without stretching. Stated another way, the closest distance between intermeshing roller bars 206 is greater than the thickness of the sheet being processed.

In accordance with an important feature of the invention, the roller bars 206 rotate as the sheet metal 208 is processed through the corrugator, thereby eliminating any sliding contact, stretching or galling between the sheet metal and the roller bars. This is extremely important when the sheet metal has been previously painted or precoated, so that the coating is not marred, scratched or disturbed as the corrugations are formed. As will be set forth in more detail below, the upper spoked reel 200 is adjustable in a vertical direction with respect to the bottom spoked reel 202 to form corrugations with different dimensions between the peaks and valleys.

According to the preferred form of the invention, each spoked reel 200 and 202 includes twelve spokes 204 equidistantly spaced around the wheel 210. The outer diameter from the tip of one spoke to an opposite spoke tip is about twelve inches. As can be appreciated, when the spokes 204 and thus the roller bars 206 are spaced closer together about the circumference of the reel 200, the number of corrugations per unit length is greater.

FIG. 7 shows a general frontal view of the intermeshed spoked reels 200 and 202. Each spoked reel, such as reel 202, includes sections 212, 214 and 216 ganged together to increase the width of the corrugator and thereby permit wide sheet metal stock to be corrugated. Reel sections 212 and 216 are about 24 inches wide, while the center reel section 214 is about 28 inches wide. Of course, different numbers of sections and widths of sections can be utilized to corrugate sheet metal of different widths. The spoked reel 200 is constructed substantially identical to the spoked reel 202, and thus the details of the spoked reel 202 will be described in more detail in conjunction with FIG. 8, which illustrates the spoked reel 202 with the parts thereof removed from each other for clarity of understanding.

Each of the four spoked wheels 210 are identical, and are fabricated of steel. Each spoke 204 has a lateral bore 220 for accommodating an axle rod 222 to thus support the roller bar 206. A threaded bore is formed radially in the end of spoke 204 for inserting therein a set screw 224 which engages a flat surface 226 on the axle rod 222. With this arrangement, the axle rod 222 is fixed with respect to the spoked wheel 210. The length of the axle rod 222 is sufficient to pass through the tubular member 244 of the first reel section 212, through the adjacent spoked wheel 228 and into the end of the tubular member of the middle reel section 214. A second axle rod 232 is adapted for passing through the bores in the spokes of the spoked wheels 234 and 236 for supporting both ends of the tubular member of reel section 216 and one end of the tubular member of the middle reel section 214. A ball bearing 240 is press fit into the recessed end 242 of a tubular member 244 of the roller bar 206. Another ball bearing 246 is press fit into the opposite end of the tubular member 244. The diameter of the axle rod 222 is such that it provides a light press fit within the bearings 240 and 246.

Figure 8:
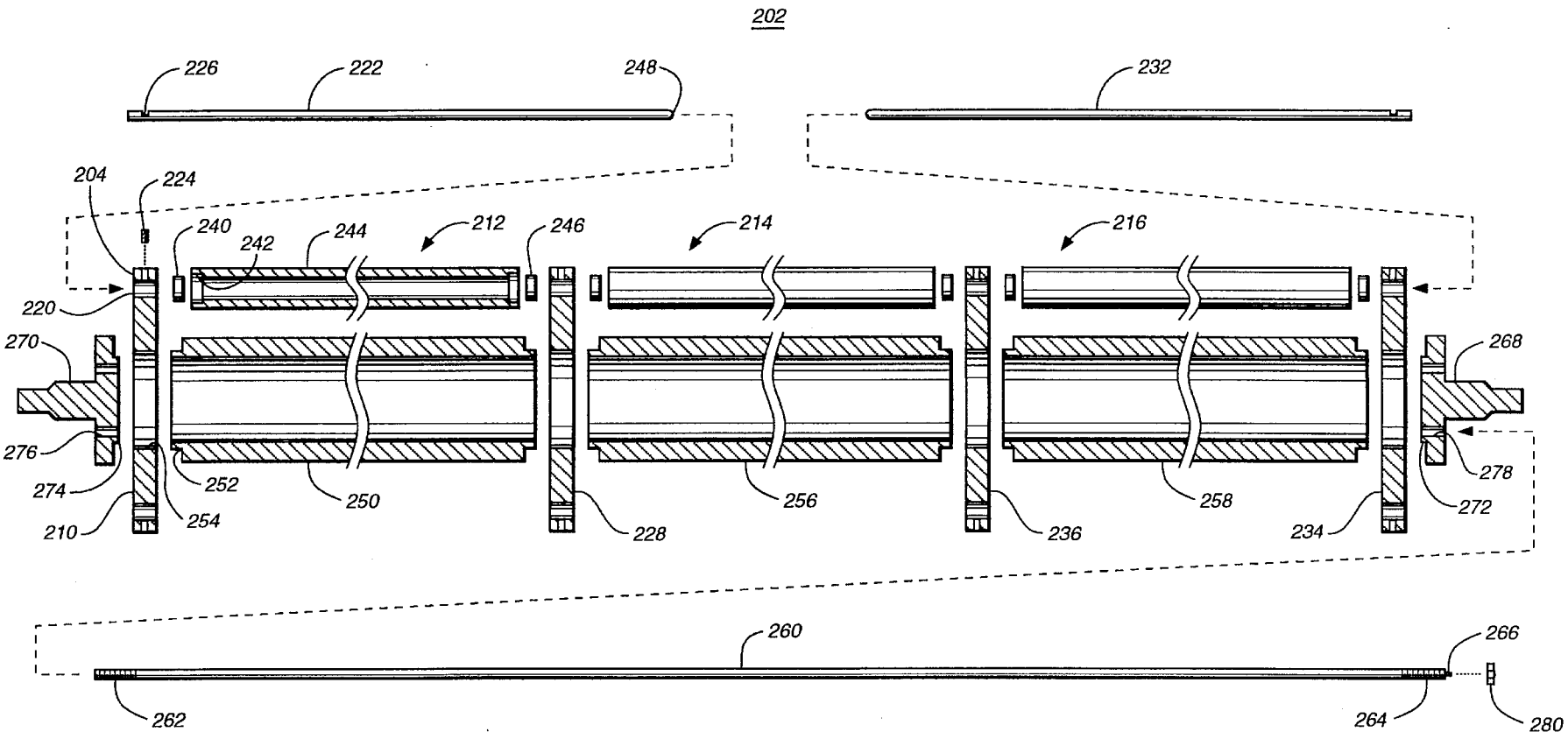
FIG. 8 is an exploded view illustrating the component parts of a corrugating reel.

As can be seen in FIG. 8, the axle rod 222 has a tapered or rounded end 248 for ease in centering within the bearings 240 and 246, as well as passing through the bore of spoked wheel 228. The remainder of the thirty-five roller bars are rotatably mounted to the respective spoked wheels in the same manner. The tubular rollers of reel sections 212 and 216 are about 23 inches long, while the tubular rollers of the center section 214 are about 27 inches long. The outside diameter of all the roller bars is about 1 15/16 inch. Each of the tubular rollers is constructed of a steel tubular material.

Each spoked wheel, such as 210 and 228 are maintained in a spaced-apart relationship by a cylindrical spacer 250. The cylinder spacer 250 has an annular shoulder 252 that snugly fits partially within the central opening 254 of the spoked wheel 210. The other end of the cylinder spacer 250 is constructed in the same manner to snugly fit partially within the spoked wheel 228. The other two cylinder spacers 256 and 258 engage the respective spoked wheels in the same manner. Each of the cylinder spacers is about 7.5 inches in diameter. The outer cylinder spacers 250 and 258 are about 24 inches long, while the center cylinder spacer 256 is about 28 inches long.

The components of the spoked reel 202 are clamped together by the utilization of six rods 260 that have threads 262 and 264 at respective ends thereof. The rod 260 is flattened 266 at one thereof so that a wrench can be used to prevent rotation of the rod 260 when clamping the components of the three spoked reel sections together. The opposing ends of the spoked reel 202 are capped by a first bearing hub 268 and an opposing bearing hub 270. Each bearing hub 268 and 270 has a reduced diameter portion 272 and 274 that snugly fits partially within the center bores of the outer spoked wheels 234 and 210. The bearing hub 270 has six threaded holes 276, while the bearing hub 268 has six drilled bores therethrough, as shown in FIG. 8. The threaded end 262 of the rod 260 can be screwed into the threaded holes 276 of the bearing hub 270. On the other hand, the holes 278 of the bearing hub 268 are larger than the threaded ends 262 and 264 of the rod 260. The components of each spoked reel section are clamped together by passing the threaded end 262 of the rod 260 through one of the holes 278 of the bearing hub 268, passed through the cylinder spacers 258, 256 and 250, and threaded into one of the threaded holes 276 of the bearing hub 270. After all six rods 260 are similarly installed, a nut 280 is screwed on the threaded end 264 of each rod 260. A wrench can by utilized on the flat surfaces 266 to maintain the rod 260 stationary while another wrench tightens the nut 280 to tightly clamp the reel section components together. Before the reel sections are tightly clamped together using the rods 260 and nuts 280, one roller bar in each reel section 212, 214 and 216 is installed and all three roller bars are aligned axially with a jig. Then, the nuts 280 are tightened to the respective six rods 260. The remaining thirty-three roller bars are then installed.

The round shaft portions of the bearing hubs 268 and 270 are supported by bearings for allowing rotation of the sprocket reel 202. The bearing hub of the bottom reel 202 has a machined key slot for mounting thereto a drive wheel. The bottom spoked reel 202 is driven by a motor and gear reduction so that the roller bars intermesh as shown in FIG. 6. The top reel 200 is not driven via the hub shafts, but rather is rotated by way of the intermeshing roller bars with the driven bottom reel 202. Because the roller bars 206 are rotatably mounted to the reels, very little friction exists during the corrugating process. As a result, very little power is required to drive the sprocket reels 200 and 202.

Figure 9:
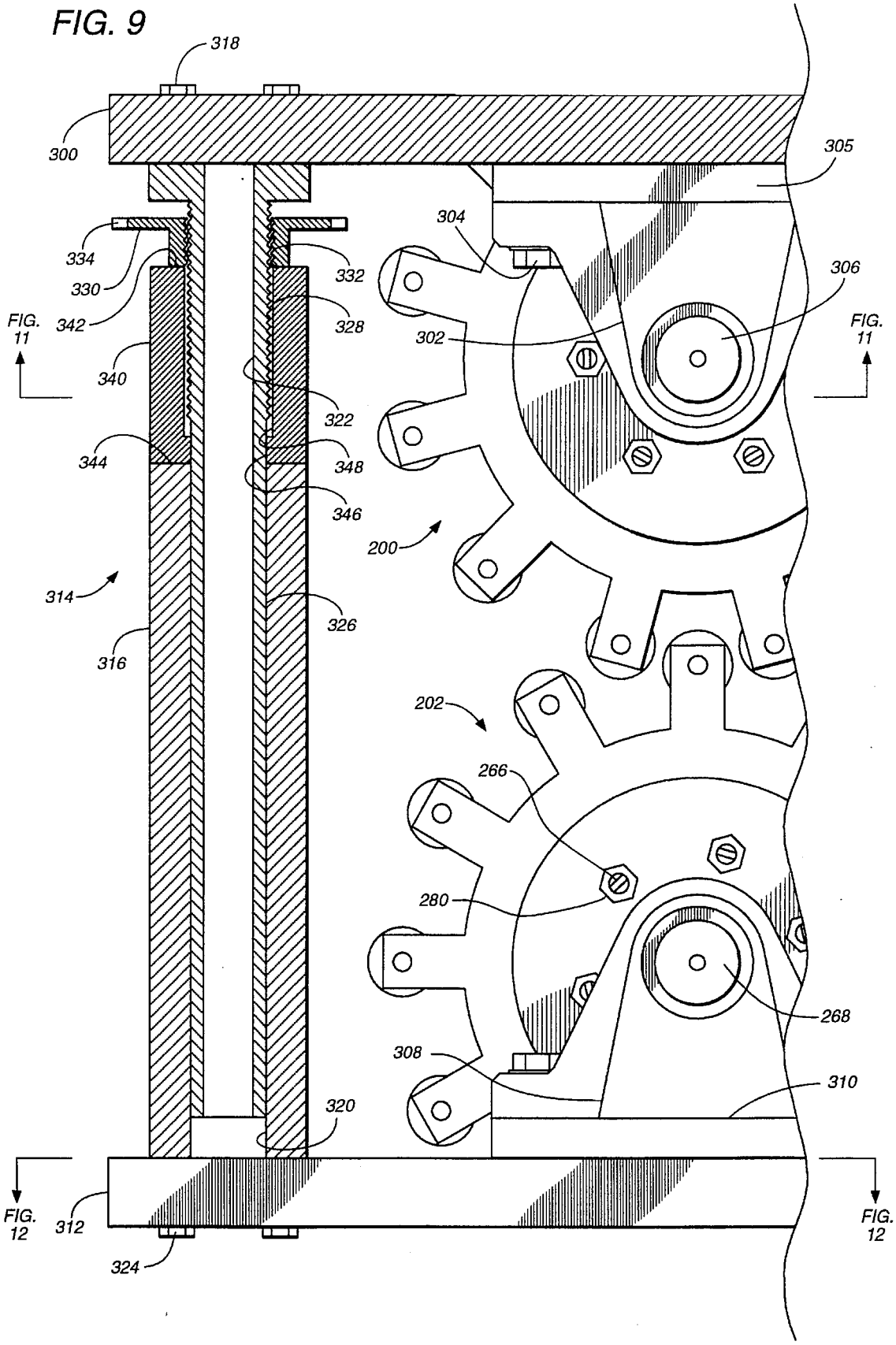
FIG. 9 is a partial sectional view of the frame and vertical adjustment support for vertically spacing the top reel with respect to the bottom reel.

The spoked reels 200 and 202 are supported in a vertically spaced apart manner with the structure shown in FIG. 9. The top spoked reel 200 is fixed to a top support plate 300 by a pillow bearing 302. The shaft 306 of the bearing hub is rotatably supported by the bearing 302. The bearing 302 is fixed to the top support plate 300 by bolts 304 and a spacer plate 305. The bolt 304 can be fastened to the top support plate 300 by a threaded hole (not shown) in the support plate 300. A hub shaft 268 of the bottom spoked reel 202 is similarly rotatably mounted within a pillow bearing 308. The lower pillow bearing 308 is fastened via a spacer plate 310 to a bottom support plate 312.

The upper spoked reel 200 and the lower spoked reel 202 are supported in a vertical spaced-apart relationship by four adjustable vertical supports, one shown as reference character 314. The top support plate 300 includes other I-beam supports to provide a rigid frame structure. The bottom support plate 312 is also a rigid structure much like the top frame structure. The top frame structure is maintained vertically registered above the bottom frame structure by the four vertical supports 314 at each corner. The vertical support 314 includes cylindrical parts that are telescopically adjusted with respect to each other to vary the vertical distance between the top support plate 300 and the bottom support plate 312. In this manner, the extent to which the roller bars of the top reel 200 and the bottom reel 202 intermesh can be adjusted. Essentially, the vertical adjustment between the top reel 200 and the bottom reel 202 determines the peak-to-valley dimension of the corrugations.

A bottom outer cylinder 316 is bolted or otherwise fastened to the bottom support plate 312 by bolts 324. The outer cylinder 316 has a smooth internal bore 320. An inner cylinder 322 is fastened to the top support plate 300, again by suitable bolts 318. The inner cylinder has a smooth outside surface 326 that is telescopic within the bore 320 of the outer cylinder 316. A top portion of the inner cylinder 322 is externally threaded 328 for about four inches, thereby allowing vertical adjustments between the top support plate 300 and the bottom support plate 312. A sprocket wheel 330 has internal threads 332 that threadably mate with the external threads 328 of the inner cylinder 322. The sprocket wheel 330 includes peripheral teeth 334 for engagement with a chain (not shown) so that when the chain is moved, the sprocket wheel 330 turns and provides a vertical adjustment of the top inner cylinder 322 with respect to the bottom outer cylinder 316. A collar 340 is interposed between a bottom shoulder 342 of the sprocket wheel 330 and a top shoulder 344 of the bottom outer cylinder 316. The collar 340 has a portion 346 that fits snugly around the smooth outer surface 326 of the inner cylinder 322. The collar 340 further includes a recessed portion 348 that is not threaded and freely passes over the external threads 328 of the inner cylinder 322.

In operation, it can be seen that as the sprocket wheel 330 is rotated to move upwardly on the inner cylinder 322, the weight of the top support plate 300 and attached apparatus pushes the collar 340 downwardly against the top shoulder 344 of the outer cylinder 316. The outer cylinder 316 is thereby telescopically contracted with respect to the inner cylinder 322. The top reel 200 is thereby moved downwardly toward the bottom reel 202. Opposite rotation of the sprocket 330 moves the top reel 200 upwardly away from the bottom reel 202.

The idler sprocket 349 of FIG. 10 is constructed very much like the top cylinder 322 and the sprocket wheel 330 of FIG. 9. An externally threaded inner cylinder 350 has a base 351 that is bolted to the angle iron support 352. An internally threaded sprocket wheel 353 with peripheral teeth 354 is threadably mounted to the inner cylinder part 50. With this construction, as a chain engages the sprocket teeth 354, and is moved, the sprocket wheel 353 advances up or down the threaded cylinder part 350, thereby following the up or down travel of the sprocket wheels of the four adjustable vertical supports 314, 358, 60 and 364. The idler sprocket wheel 353 has a number of holes 355 drilled in the base for use in manually rotating the sprocket wheel 353 with a spanner wrench. This moves chain 356 (FIG. 11) and thus raises or lowers the top frame structure of which top support plate 300 is a part.

FIG. 11 is an upward view, taken along line 11 of FIG. 9, illustrating the general construction of the upper frame structure and adjustable vertical construction of the upper frame structure and adjustable vertical supports for adjusting the distance between the top spoked reel 200 and the bottom spoked reel 202. The spoked reels are removed from FIG. 11 to better illustrate the frame structure. The top frame structure, part of which is support plate 300, is supported by telescopic vertical supports 314, 358, 360 and 364 at the four corners as shown for one corner in FIG. 9. The angle irons 352 and 366 are bolted onto this upper frame structure as in FIG. 10. Midway between the corner sprocket wheels are four idler sprocket wheels 349, 357, 362 and 363. These idler wheels are fixed to the respective angle irons 352 and 366 in the manner shown in FIG. 10.

A chain 356 shown in a dashed line in FIG. 11, extends around the rectangular periphery of the frame, and engages all eight sprocket wheels. Accordingly, as the chain is moved horizontally either to the left or right, all eight sprocket wheels rotate either clockwise or counter-clockwise and thereby either lower or raise the upper frame structure with respect to the bottom frame structure. The chain 356 can be advanced manually with the spanner wrench.

It should also be understood that in the initial assembly of the corrugator machine, each of the sprocket wheels of the vertical supports at the corners are rotatably adjusted so that the top frame structure is exactly parallel to the bottom frame structure. Also, the idler sprockets 349, 357 and 362, 363 are adjusted accordingly, even though such sprockets are not effective to move the top frame structure. Then, the chain 356 is installed so as to be engaged with all eight sprockets so that when laterally moved, the entire top frame structure is moved upwardly or downwardly in unison.

Figure 12:
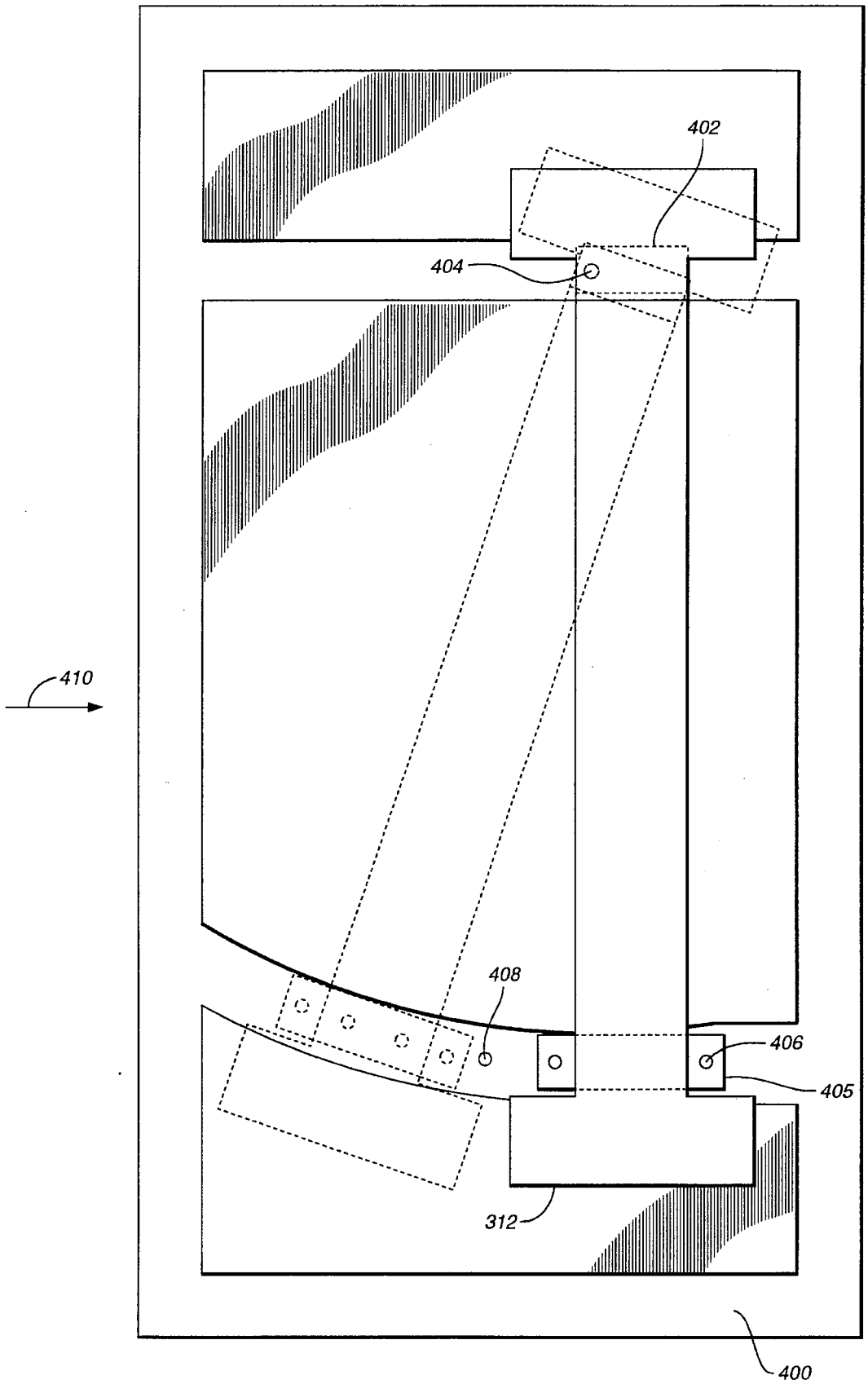
FIG. 12 is a view of the corrugating machine, taken along line 12—12 of FIG. 9, showing the manner in which the machine can be angled with respect to an in-feed table to form angled corrugations in sheet metal stock.

FIG. 12 is a top view taken along line 12 of FIG. 9. In FIG. 12, there is shown a flat table structure 400 on which the corrugator machine is pivotally fastened. The table 400 is of a heavy duty construction to support the corrugator machine thereon. The table 400 can be constructed with I-beam supports thereunder. The table surface itself can be a heavy duty plate steel to provide a level surface for the corrugator machine, as well as a platform for supporting elevated in-feed and out-feed surfaces for the precoated sheet stock. In accordance with an important feature of the invention, a plate 402 is welded below bottom support 312. Moreover, the plate 402 is fixed at a corner thereof to the table 400 by a pivot shaft 404 to allow the corrugator machine to pivot about such point, such as shown by the broken lines. The pivot point is at the corner of the plate 402 so that irrespective of the extent by which the entire unit is pivoted, the point at which the roller bars engage the incoming sheet does not vary. Further, another plate 405 is also welded below the bottom support 312 and has two holes 406 for fastening to the table 400 at various angular locations with corresponding table holes 408. Each table hole 408 in the table 400 can be located about an arc with respect to the pivot point 404. Each table hole 408 can be located at a desired angle so that precoated sheet metal can have corrugations formed therein at the same angle. The arrow 410 in FIG. 10 illustrates the direction in which the precoated sheet metal stock is advanced between the roller bars of the top and bottom reels. Importantly, when the corrugator machine is pivoted to form corrugations angled with respect to the side edge of the precoated sheet stock, as shown in FIG. 5, the frontal edge of the sheet stock is precut to the same angle so that the entire leading edge of the sheet enters the corrugating machine parallel to the roller bars. While not shown, one edge fence can be fastened to the in-feed table for guiding the sheet stock as it is fed to the corrugator machine. While the corrugator machine shown in FIG. 12 is manually pivoted to the desired angle, and then fastened to the table 400, those skilled in the art may prefer to swivel the corrugator machine by way of pneumatic, hydraulic or electrical devices.

Disclosed is a corrugator machine which easily and efficiently forms corrugations in sheet metal stock. The corrugating machine operates with very little power, and prevents stretching, scratching or marring of the coating on the sheet metal stock during the corrugating process.

What is claimed is:

1. A corrugating machine, comprising:

a first reel having a plurality of ganged sections rotated together about a common first axis, each said reel section having a different plurality of roller bars supported peripherally therearound, each said different plurality of roller bars being mounted to a respective section so as to be independently rotatable with respect to the roller bars of the other ganged section;

said first reel ganged sections having a common wheel support for rotatably mounting thereto the different plurality of roller bars of two said sections;

a second reel having a plurality of ganged sections rotated together about a common second axis, each said second reel section having a different plurality of roller bars supported peripherally therearound, each said second different plurality of roller bars being mounted to a respective section of said second reel so as to be independently rotatable with respect to the roller bars of the other ganged section; and said second reel ganged sections having a common wheel support for rotatably mounting thereto the different plurality roller bars of two sections of said second reel, whereby when sheet metal stock is passed between said first and second reels, said sheet metal stock is deformed so as to form corrugations therein.

2. The corrugating machine of claim 1, further including a frame for rotatably mounting said first reel spaced from said second reel, and an adjustment mechanism for adjusting a spacing between said first reel and said second reel.

3. The corrugating machine of claim 2, wherein said adjustment mechanism is adapted to vary a peak-to-valley dimension of a corrugation formed in the sheet metal stock.

4. The corrugating machine of claim 2, wherein the adjustment mechanism comprises a top frame for rotatably mounting thereto said first reel, a bottom frame for rotatably mounting thereto said second reel, and a threaded arrangement having a first threaded member engaged with a second threaded member for supporting said top frame above said bottom frame, and the spacing between the top frame and said bottom frame is varied when the first threaded member is rotated with respect to the second threaded member.

5. The corrugating machine of claim 4, further including a sprocket wheel that is rotatable for turning one threaded member with respect to the other threaded member.

6. The corrugating machine of claim 5, further including a plurality of said threaded arrangements for supporting said top frame above said bottom frame, and a plurality of sprockets rotatable in unison by a chain.

7. The corrugating machine of claim 1, wherein the roller bars of the first and second reels are peripherally spaced apart so as to intermesh with each other.

8. The corrugating machine of claim 7, wherein a spacing between a roller bar of the first reel intermeshed with two roller bars of the second reel is greater than a thickness of the sheet metal to be corrugated.

9. The corrugating machine of claim 1, wherein only one of the first or second reels is driven in a rotary manner, and the roller bars of the driven reel intermesh with the roller bars of a non-driven reel, with the sheet metal stock passing therebetween.

10. The corrugating machine of claim 9, wherein the spacing between the intermeshed roller bars is such that the sheet metal stock is not compressed.

11. The corrugating machine of claim 1, wherein said sections of each reel are clamped together by threaded rods that pass through each reel section.

12. The corrugating machine of claim 1, wherein said roller bars are each mounted by bearings to respective hubs of said reels.

13. The corrugating machine of claim 1, further including in combination an in-feed table for delivering flat sheet metal stock to the corrugating machine, and further including a mount for mounting the corrugating machine for pivotal movement with respect to the in-feed table so that the sheet metal stock is fed at an angle other than 90° to the corrugating machine.

14. A method of corrugating sheet metal stock, comprising the steps of:

pivoting a corrugating machine and maintaining an in-feed table stationary to thereby form an angle between the corrugating machine and a path of the sheet metal stock;

feeding sheet metal stock via said in-feed table along said path so that corrugations are formed in the sheet metal stock at an angle other than a right angle with respect to a side edge of the sheet metal stock;

rotating a pair of corrugating reels of the conjugating machine together so that roller bars mounted thereto intermesh to form the angled corrugations in the sheet metal stock; and causing the roller bars to rotate with respect to the respective reels but remain stationary with respect to the sheet metal stock engaged therewith, whereby the corrugated sheet metal is not scratched or marred.

15. The method of claim 14, further including varying a spacing of a first corrugating reel apart from a second intermeshed corrugating reel to vary a peak-to-valley dimension of the corrugations.

16. The method of claim 14, further including driving only one reel with a motor, whereby rotation thereof causes the other intermeshed reel to rotate by way of the roller bars.

17. The method of claim 14, further including corrugating the sheet metal stock by deformation thereof without compressing the sheet metal stock between the roller bars.

18. The method of claim 14, further including forming corrugations in precoated sheet metal stock without substantially scratching or marring the coating.

19. The method of claim 14, further including pivotally moving the corrugating machine about a vertical axis while maintaining the in-feed table stationary.

20. A corrugating machine, comprising:

a first reel mounted for rotation about a first axis, said first reel having at least a pair of ganged sections axially aligned, each pair of ganged sections having a common center support wheel with spoke-like projections extending radially therefrom, each said spoke-like protection of a section supporting a different roller bar for independent rotation with respect to the other roller bars of the section, each roller bar extending axially substantially across a respective said ganged section, and each said spoke-like projection being shaped at an outer radial end thereof so as not to protrude in a path of sheet stock to be corrugated;

a second reel mounted for rotation about a second axis parallel to said first axis, said second reel having at least a pair of ganged sections axially aligned, each pair of ganged sections having a common center support wheel with spoke-like projections extending radially therefrom, each said spoke-like projection of a section supporting a different roller bar with respect to the other roller bars of the section, and each roller bar of said second reel extending axially substantially across a respective said ganged section, and each said spoke-like projection being shaped at an outer radial end thereof so as not to protrude in a path of sheet stock to be corrugated;

a frame for rotatably mounting said first reel with respect to said second reel so that the roller bars of said first reel intermesh with respective roller bars of said second reel, an engagement between the roller bars being the only driving force exerted on said first reel with respect to said second reel; and a drive mechanism attached to said second reel for rotatably driving said second reel which thereby drives said first reel.

* * * * *